United States Patent [19]

Perkins

[11] 3,955,724

[45] May 11, 1976

[54] HOLSTER

[75] Inventor: Neale A. Perkins, Sierra Madre, Calif.

[73] Assignee: Safariland Ltd. Inc., Monrovia, Calif.

[22] Filed: Dec. 5, 1974

[21] Appl. No.: 529,898

[52] U.S. Cl. ..... 224/2 B

[51] Int. Cl.[2] ..... F41B 13/04

[58] Field of Search ..... 224/2 B, 5 R, 5 A, 26 R, 224/26 B; 112/417, 440; 190/53, 55 R, 40; 428/473, 474, 500; 36/57, 9 R

[56] References Cited

UNITED STATES PATENTS

| | | | |
|---|---|---|---|
| 3,010,114 | 11/1961 | Lipschultz | 112/417 X |
| 3,642,183 | 2/1972 | Boren | 224/2 B |

*Primary Examiner*—Albert J. Makay
*Assistant Examiner*—Randolph A. Reese
*Attorney, Agent, or Firm*—Christie, Parker & Hale

[57] ABSTRACT

A holster includes a continuous piece of leather folded along two spaced apart and generally parallel fold lines to form an end wall which is continuous with the inner and outer side walls of the holster. The continuous end wall resists wear and tear from a heavy automatic weapon constantly being pushed down into the holster. The holster also has a belt loop attached to the inner side wall of the holster by nylon stitching extending through a thin, flexible sheet of thread-holding material disposed between the belt loop and the holster side wall. The thread-holding sheet resists the possibility of the belt loop being torn away from the holster. An extension of the inner side wall panel holds a female snap ring fastener for receiving a male snap ring fastener on a strap which loops over the hammer of the firearm. The female snap ring is recessed to prevent interference with a firearm being withdrawn from the holster.

12 Claims, 7 Drawing Figures

Fig. 4
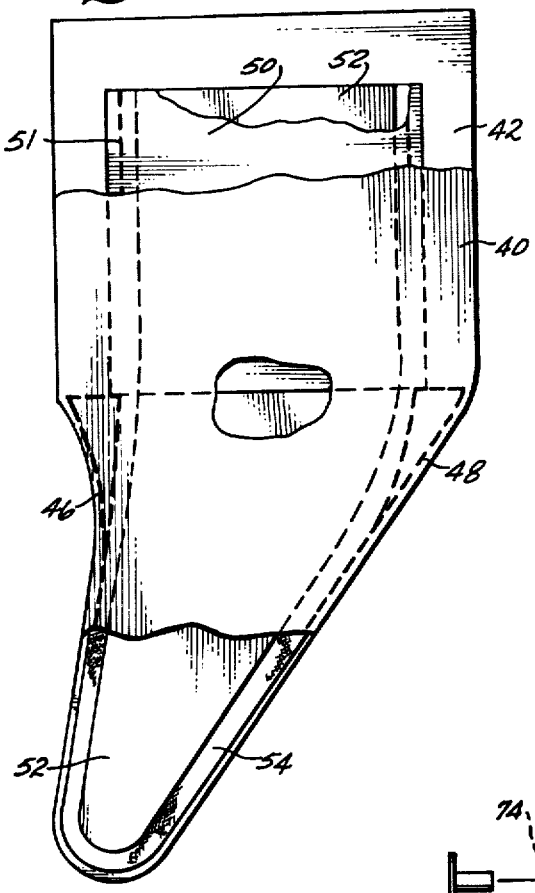
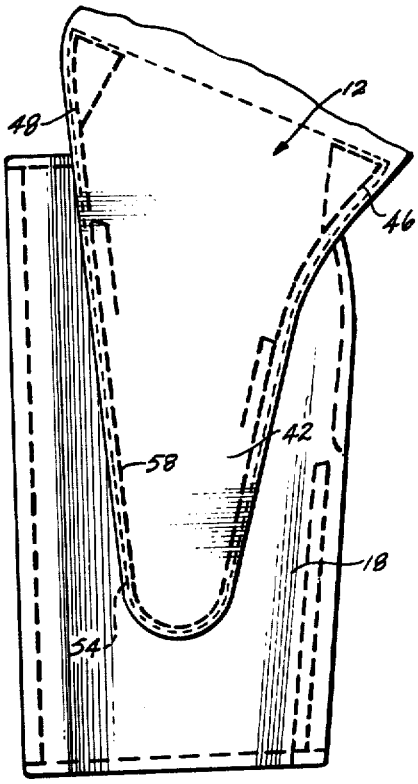
Fig. 6
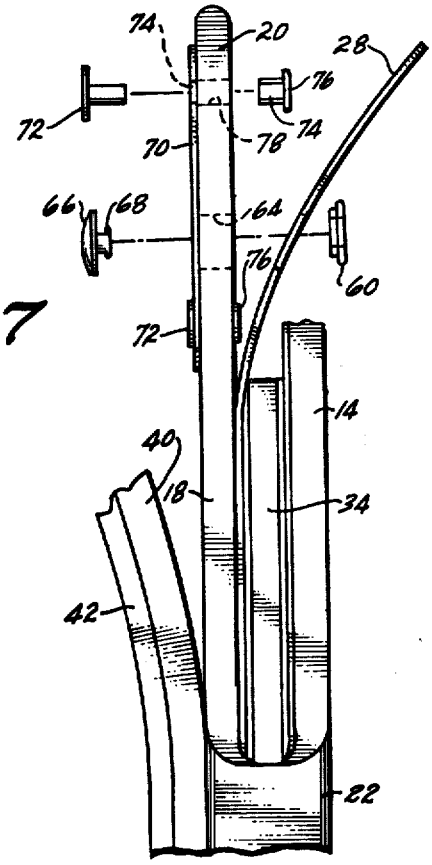
Fig. 7
Fig. 5
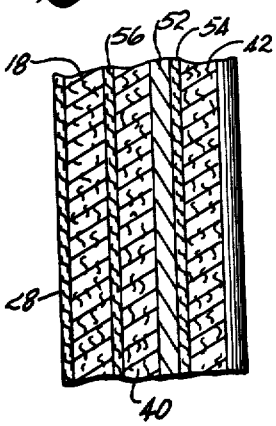

HOLSTER

BACKGROUND

This invention relates to holsters, and more particularly, to an improved holster havin good resistance to wear, such as ripping of nylon threads, common to conventional holsters.

Holsters worn by off-duty and plainclothes law enforcement officers are commonly attached to a belt worn around the officer's waist to hold the hoster extremely close to the body to conceal the firearm. In many prior art holsters, the stitching can be torn relatively easily during use. This can prevent the firearm from fitting snugly into the holster, and also prevent the holster and firearm from being held close to the body of the user. In addition, stitching which is easily torn can be a safety hazard to law enforcement officers, because it can result in the officer's firearm being taken from his holster, or his holster being ripped away from its belt loop, by an unauthorized person.

Many prior art holsters are of such design that they prevent the firearm from being drawn quickly without some part of the holster interfering with the firearm.

SUMMARY

This invention provides a holster in which certain areas which are normally vulnerable to relatively easy ripping of nylon stitching in the prior art are designed to resist such wear and tear even during relatively heavy use of the holster.

For example, one problem which is characteristic of prior art holsters is the ripping of nylon threads at the back of the holster. In the prior art, the back of the holster is commonly formed by a leather piece sandwiched between the ends of the inner and outer sides of the holster and held together by stitching. During use, a heavy automatic being constantly pushed down into the holster eventually rips the stitching at the back of the holster. In the present invention, this problem is overcome by forming the back of the holster from a single piece of leather folded to provide an end wall which is continuous with the inner and outer side walls of the holster. The continuous end wall wraps around a spacer which is fastened between the inner and outer side walls by stitching. The continuous end wall resists the stitching at the back of the holster from being torn during use when a heavy automatic is constantly pushed down into the holster.

Another problem characteristic of the prior art has to do with the stitching which attaches the belt loop to the holster side wall. The stitching used in the prior art is vulnerable to becoming torn or weakened, which prevents the holster from being worn close to the body, and also makes it possible for an unauthorized person to rip the holster away from the belt loop. In the present invention, this problem is overcome by placing a sheet of thread-holding material between the belt loop and the holster side wall. The belt loop is attached to the holster by stitching through the thread-holding sheet. This resists tearing of the threads when a force is applied to the belt loop which would tend to separate it from the holster.

Prior art holsters also have a leather strap which loops over the hammer of the firearm and attaches to a protruding snap ring fastener which often interferes with the firearm being withdrawn from the holster. In the present invention, the snap ring fastener is recessed in the side wall panel of the holster to avoid interfering with the firearm being withdrawn.

These and other aspects of the invention will be more fully understood by referring to the following detailed description and the accompanying drawings.

DRAWINGS

FIG. 4 is an elevation view, partly broken away, and taken along line 4—4 of FIG. 2;

FIG. 5 is an enlarged fragmentary cross-sectional elevation view showing the construction within the circle 5 of FIG. 2;

FIG. 6 is a fragmentary elevation view taken along line 6—6 of FIG. 2; and FIG. 7 is a fragmentary, partly exploded, elevation view showing the construction within the circle 7 of FIG. 1.

DRAWINGS

Figure 1:
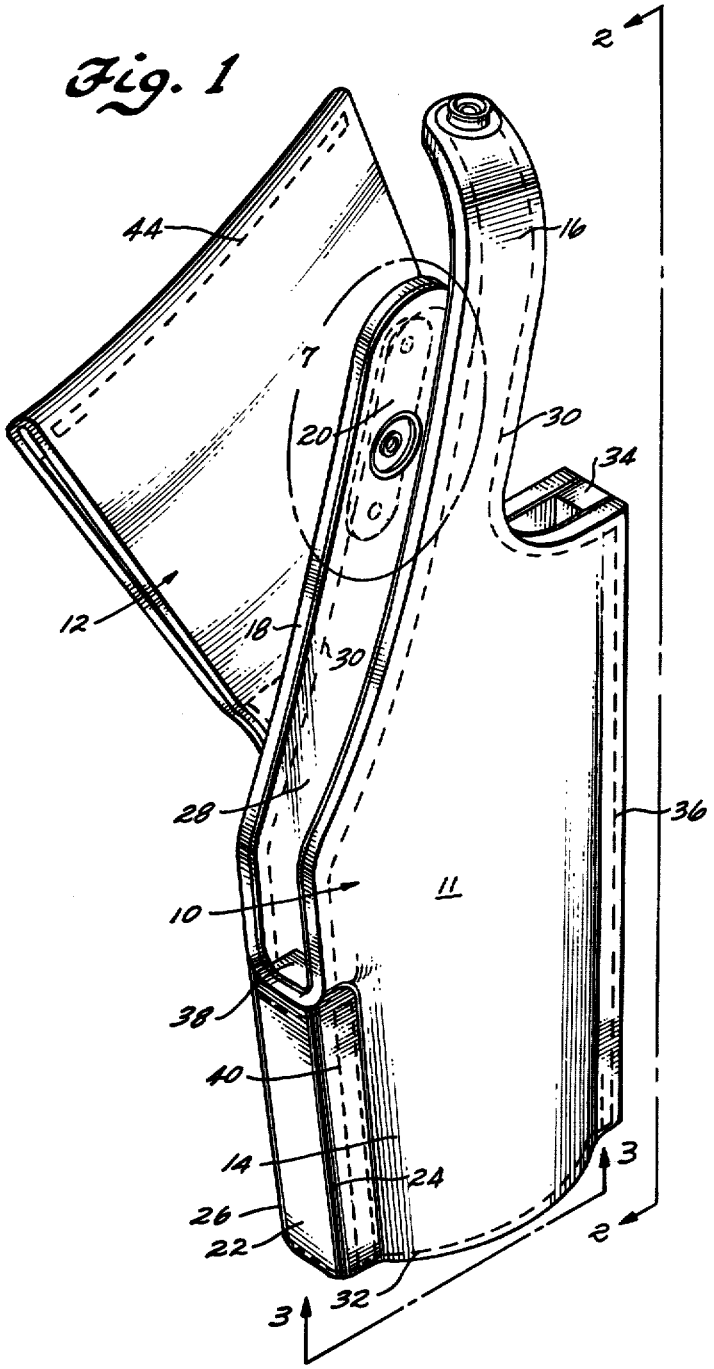
FIG. 1 is a perspective view showing the holster of this invention.

Referring to the drawings, a holster 10 according to this invention includes an upright, relatively rigid, elongated belt loop 12 for wearing the holster relatively close to the body to conceal the firearm and holster. The holster is the type preferably worn by off-duty and plainclothes officers for carrying a concealed heavy automatic weapon, for example.

The holster includes a single piece of leather 11 shaped to form an outer side wall 14 which tapers at its top to form a narrow elongated strap 16 which loops over the hammer of a firearm carried in the holster. The single piece of leather 11 also includes an inner wall 18 which tapers at its top to form a narrow elongated extension 20, and an upright end wall 22 at the rear of the holster which is continuous with the inner and outer walls 18,14. The continuous end wall 22 is a long and narrow upright section of the leather piece formed between two spaced-apart, generally parallel, upright fold lines 24 and 26 at the ends of the outer and inner side walls 14 and 18, respectively.

An inner lining 28 of orthopedic elk suede, which is tanned to remove acids that might attack the surface of the firearm, is attached to the inside of the leather piece 11. The inner lining 28 is cemented against the inside of the leather piece and secured to it by stitching 30 extending around the top peripheral portion of the leather piece, and by stitching 32 at the bottom of the leather piece.

At the front edge of the holster, the two spaced-apart ends of the leather piece 11 are secured together by cementing a narrow, elongated leather end-piece 34 in upright position between them, and running rows of stitching 36 through each side of the leather piece and through the end-piece 34. At the rear edge of the holster an elongated narrow leather end-piece 38 abuts against the inner surface of the continuous end wall 22. The end piece 38 is cemented against the inner surfaces of the inner and outer side walls 18,14 and the end wall 22 and is secured in its upright position by a double row of nylon stitching 40.

The thickness of each leather piece 34 and 38 is varied to produce the desired spacing between the inner and outer side walls of the holster to accommodate different sizes of firearms. In addition, the shape of the inner and outer side walls is molded to the shape of the particular firearm designed with use with the holster.

The continuous wrap-around of leather at the rear of the holster substantially prevents the stitching at the rear of the holster from being torn during use. This overcomes the problem common to prior art holsters in which nylon threads are stitched through a leather layer sandwiched between the edges of the inner and outer sides of the holster. Under such a construction a heavy automatic being constantly pushed into the holster tends to rip the nylon threads at the back of the holster. The continuous wrap-around of leather in the end-wall 22 overcomes this problem.

The holster of this invention also includes a means for attaching belt loop 12 to the inner side panel 18 so that the stitching will resist either becoming loosened by wear during heavy use, or being torn when an unauthorized person attempts to rip the holster away from the belt loop. This construction includes forming the belt loop from a pair of overlying inner and outer leather pieces 40 and 42, respectively. The inner and outer leather pieces 40 and 42 are fastened together at their top by a row of stitching 44, and are fastened together at their intermediate sections by two rows of stitching 46 and 48 on opposite sides of the belt loop. Each row of stitching 46 or 48 is generally triangular in shape as shown best in FIG. 4. The space between the top row of stitching 44 and the intermediate rows 46 and 48 provides a loop through which a belt (not shown) can be threaded for wearing the holster.

Figure 2:
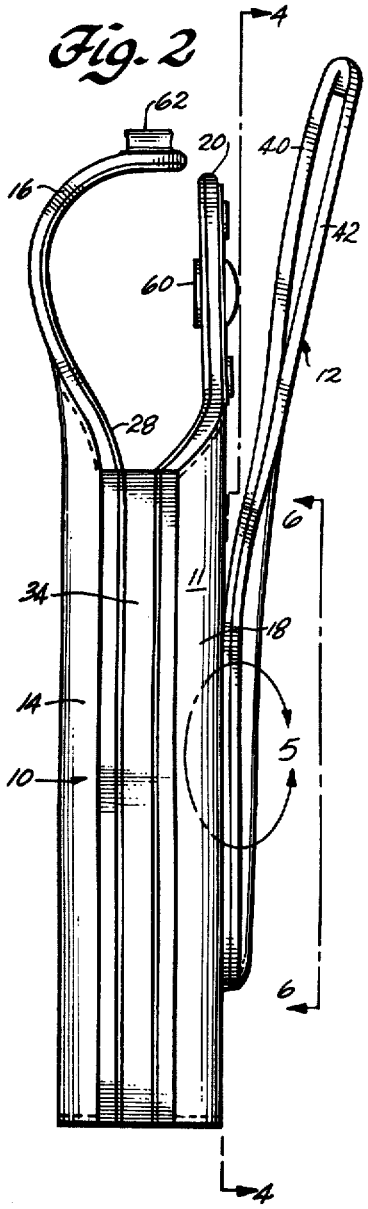
FIG. 2 is an elevation view taken along line 2—2 of FIG. 1.
Figure 3:
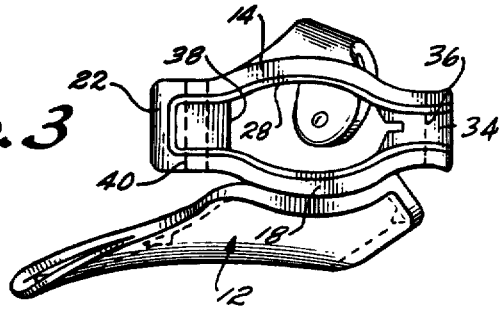
FIG. 3 is a bottom plan view taken along line 3—3 of FIG. 1.

A leather pocket 50 is attached to the inner surface of the outer leather piece 42 between the top row of stitching 44 and the intermediate rows 46 and 48. The pocket is fastened to the leather piece 42 by two vertical rows of stitching 51 on opposite sides of the pocket, which forms an open top and an open bottom to the pocket. The pocket holds a narrow, generally triangular, rigid metal plate 52 which is shaped to conform generally to the shape of the inner and outer leather pieces 40 and 42. The metal plate 52 provides rigid reinforcing for the belt loop. It is also bent to provide the lateral shaping of the belt loop which, as viewed in FIG. 2, extends parallel to the side of the holster at its bottom and then is bent outwardly away from the holster at its top.

A thin, flexible, thread-holding sheet 54 is placed between a bottom portion of metal plate 52, which projects downwardly from the pocket 50, and the inner surface of the outer leather piece 42. The thread-holding sheet is generally triangular in shape, conforming to the shape of the lower half of the belt loop. It is held in place at its top by the rows of stitching 46 and 48. The threadholding sheet is made from a material capable of holding nylon threads so that it will provide greater resistance to tearing of the threads than when two leather layers are stitched together without the thread-holding sheet. Preferably, the thread-holding sheet 54 is made from glass strand impregnated vinyl, or flexible nylon sheeting. If desired, a second thread-holding sheet 56, made from the same type of material, can be placed between the lower or shank portion of the leather piece 40 and the side wall 18 of the holster. As shown best in FIG. 6, the shank portion of the belt loop 12 is attached to the inner side wall 18 of the holder by a row of nylon stitching 58 along the lower peripheral portion of the belt loop shank. The stitching 58 passes through the thread-holding sheets 54 and 56.

In use, thread-holding sheets overcome the problem common to prior art holsters in which a leather belt loop is stitched directly to the inside of the leather holster. If an unauthorized person pulls on the holster, it can be ripped away from the belt loop. The thread-holding sheets 54 and 56 overcome this problem, because they improve the holding strength of the nylon thread in the leather, and thereby resist tearing of the threads when the holster is pulled away from the belt loop.

The holster also includes a means for attaching a female snap ring fastener 60 to the extension 20 of the inner side wall 18 to substantially prevent the fastener from interfering with a firearm being withdrawn from the holster. The retaining strap 16 on the outer side wall of the holster loops tightly over the hammer of the firearm, and includes a male snap ring fastener 62 which is releasably fastened to the female snap ring fastener 60. The female snap ring fastener is recessed by mounting it in a hole 64 extending through the extension 20 of the holster. The fastener 60 is held in place in the hole 64 by a generally T-shaped fastener or rivet 66 having a shank portion 68 which extends into the recess 64 and is press-fitted into engagement with a hole formed in the center of the fastener 60. The head portion of the fastener 66 bears against an elongated leaf spring 70 made of blue clock spring steel. The leaf spring 70 extends lengthwise, generally parallel to the length of the extension 18, and is attached thereto by a pair of spaced-apart rivets 72 extending through corresponding holes 74 in opposite ends of the leaf spring 70. The shank portion of each rivet 72 is press-fitted into corresponding receptacle portions 74 of spaced-apart T-nuts 76 on the opposite sides of the extension. The receptacle portions of the T-nuts 76 extend into respective holes 78 through the extension 20 for engagement with the shank portions of the corresponding rivets 72. The T-nuts are held in place by the overlying inner layer 28 of orthopedic elk suede which is attached to the extension by the stitching 30.

Thus, the female snap ring fastener 60 is held firmly in its recessed position in the extension 20 so that it will not interfere with a firearm being withdrawn from the holster.

I claim:

1. In a holster for carrying a firearm and having a leather shank portion of a belt loop attached by stitching to a leather inner pannel of the holster, an improved means for attaching the belt loop to the holster comprising a thread-holding sheet covering an area between overlying portions of the side panel of the holster and the leather shank of the belt loop; and one or more rows of threads stitched through the belt loop shank, the thread-holding sheet, and the inner panel of the holster to fasten the belt loop to the holster, the thread-holding sheet being made from a material which provides greater resistance to tearing of the threads than when the leather belt loop shank is stitched directly to the leather panel of the holster.

2. The improvement according to claim 1 in which the shank of the belt loop is made from two separate layers of leather, and includes a second one of said thread-holding sheets, a first sheet covering an area between the two leather layers of the belt loop shank, a second sheet covering an area between the shank and the holster inner panel; and in which the threads are stitched through the two leather layers of the shank, the first and second stitch-holding sheets, and the holster inner panel.

3. The improvement according to claim 1 in which the threads are made of nylon.

4. The improvement according to claim 1 in which the thread-holding sheet is made from a material selected from the group consisting of glass-impregnated vinyl and nylon sheeting.

5. The improvement according to claim 2 including a rigid metal plate between the two separate layers of leather in the belt loop for reinforcing the belt loop.

6. The improvement according to claim 5 including a flexible piece secured to an inner surface of one leather layer of the belt loop, the flexible piece having an opening for providing a pocket, the metal plate being disposed in the pocket.

7. A holster comprising:

a. a case having a leather side panel;

b. a thread-holding sheet covering an area of the leather side panel;

c. a belt loop having a leather shank overlying the thread-holding sheet so as to sandwich the sheet between the shank and the leather side panel; and d. one or more rows of threads stitched through the leather shank, the thread-holding sheet, and the leather side panel to fasten the belt loop to the holster case; the thread-holding sheet being made from a material which provides greater resistance to tearing of the threads than when the leather shank is stitched to the leather side panel absent said thread-holding sheet.

8. A leather holster according to claim 7 in which the threads are made of nylon.

9. A holster according to claim 8 in which the thread-holding sheet is made from a material selected from a group consisting of a glass impregnated vinyl and nylon sheeting.

10. A holster comprising:

a. a case having a leather side panel;

b. a first thread-holding sheet covering an area of the leather side panel;

c. a belt loop having a shank comprising first and second leather layers overlying the first thread-holding sheet;

d. a second thread-holding sheet disposed between the first and second leather layers and being generally aligned with the first thread-holding sheet; and e. means fastening the belt loop to the holster case comprising one or more rows of threads stitched through the first and second leather layers, the first and second thread-holding sheets, and the leather side panel of the holster case; the thread-holding sheets being made from a material which provides greater resistance to tearing of the threads than when the leather belt loop shank is stitched to the leather side panel absent said thread-holding sheets.

11. A holster according to claim 10 including a rigid metal plate between the first and second leather layers for reinforcing the attachment of the belt loop to the holster case.

12. A holster according to claim 11 including a flexible piece secured to an inner surface of one leather layer, the flexible piece having an opening for providing a pocket, the metal plate being disposed in the pocket.

* * * * *

UNITED STATES PATENT AND TRADEMARK OFFICE

CERTIFICATE OF CORRECTION

PATENT NO. : 3,955,724

DATED : May 11, 1976

INVENTOR(S) : NEALE A. PERKINS

It is certified that error appears in the above-identified patent and that said Letters Patent are hereby corrected as shown below:

Col. 2, line 25, "DRAWINGS" should read -- DETAILED DESCRIPTION --.

Col. 3, line 3, "with use" should read -- for use --;

line 67, "holder" should read -- holster --.

Col. 4, line 50, "pannel" should read -- panel --.

Signed and Sealed this

Third Day of August 1976

[SEAL]

*Attest:*

RUTH C. MASON
*Attesting Officer*

C. MARSHALL DANN
*Commissioner of Patents and Trademarks*